US011091843B2

(12) United States Patent
Li

(10) Patent No.: US 11,091,843 B2
(45) Date of Patent: Aug. 17, 2021

(54) ACID-PICKLING ADDITIVE FOR SURFACE OXIDE SCALE OF STAINLESS STEEL MATERIAL, PREPARATION METHOD THEREOF, AND ACID-PICKLING METHOD

(71) Applicant: ADD New Technology Development (Shanxi) Co., LTD., Taiyuan (CN)

(72) Inventor: Wenjuan Li, Shanxi (CN)

(73) Assignee: ADD New Technology Development (Shanxi) Co., LTD., Taiyuan (CN)

( * ) Notice: Subject to any disclaimer, the term of this patent is extended or adjusted under 35 U.S.C. 154(b) by 154 days.

(21) Appl. No.: 15/776,261

(22) PCT Filed: Nov. 15, 2016

(86) PCT No.: PCT/CN2016/105810

§ 371 (c)(1),
(2) Date: May 15, 2018

(87) PCT Pub. No.: WO2017/219591

PCT Pub. Date: Dec. 28, 2017

(65) Prior Publication Data

US 2019/0119820 A1 Apr. 25, 2019

(30) Foreign Application Priority Data

Jun. 22, 2016 (CN) ..... 201610459932.1
Jun. 27, 2016 (CN) ..... 201610481632.3

(51) Int. Cl.
*C23G 1/08* (2006.01)
*C23G 1/06* (2006.01)

(52) U.S. Cl.
CPC ..... *C23G 1/088* (2013.01); *C23G 1/063* (2013.01); *C23G 1/08* (2013.01); *C23G 1/081* (2013.01); *C23G 1/086* (2013.01)

(58) Field of Classification Search
CPC ..... C23G 1/088; C23G 1/08; C23G 1/081; C23G 1/063; C23G 1/086
See application file for complete search history.

(56) References Cited

U.S. PATENT DOCUMENTS 5,296,042 A * 3/1994 Curran ..... C23G 1/24 134/2

FOREIGN PATENT DOCUMENTS

| | | |
|---|---|---|
| CN | 101135056 | 3/2008 |
| CN | 104195580 A | 12/2014 |
| CN | 105297045 A | 2/2016 |
| CN | 105908197 A | 8/2016 |
| JP | S5610396 A | 2/1981 |

OTHER PUBLICATIONS

PCT Application No. PCT/CN2016/105810 Filing date Mar. 13, 2018 International Search report dated Apr. 11, 2017, 5 Pages.

* cited by examiner

*Primary Examiner* — Natasha N Campbell
(74) *Attorney, Agent, or Firm* — Thorpe North & Western

(57) ABSTRACT

Provided is an acid-pickling additive for a surface oxide scale of a stainless steel material, a preparation method thereof and an acid-pickling method. The acid-pickling additive consists of 1 to 10 parts by weight of an alcohol amine compound, 0.1 to 5 parts by weight of a metal complex ligand, 0 to 10 parts by weight of a nitrogen-containing organic cyclic compound, 0 to 3 parts by weight of an alcohol compound, 0 to 3 parts by weight of a plant extract, and 1 to 2 parts by weight of water. This acid-pickling additive can solve the problems of high energy consumption, environmental pollution, and high cost in the existing method for removing an oxide scale of a stainless steel.

9 Claims, No Drawings

ACID-PICKLING ADDITIVE FOR SURFACE OXIDE SCALE OF STAINLESS STEEL MATERIAL, PREPARATION METHOD THEREOF, AND ACID-PICKLING METHOD

TECHNICAL FIELD

The present invention pertains to the technical field of processing a surface oxide scale of a metal, and In particular relates to an acid-pickling additive for a surface oxide scale of a stainless steel material, a preparation method thereof, and an acid-pickling method.

BACKGROUND

Removal of a surface oxide scale of a hot-rolled stainless steel is an essential working procedure in the production process of the stainless steel. In addition to iron, chromium, nickel as well as a small amount of carbon, silicon and sulfur, the stainless steel also includes elements such as manganese, titanium, molybdenum, copper, niobium, and aluminum as desired. In manufacturing processes such as smelting, hot rolling, and thermal treating, these elements are inevitably oxidized to generate various oxides, such as FeO, $Fe_2O_3$, $Fe_3O_4$, $Cr_2O_3$, NiO, $Si_2$, $Cr_2O_3$.FeO (chrome spinel), NiO.$Fe_2O_3$ (nickel spinel), and the like oxides. Furthermore, the temperatures or protective atmospheres of the stainless steel at the time of heating and annealing are different, which also has a significant influence on the ingredient and structure of the oxide layer of the stainless steel. Therefore, the thickness and the layer numbers of the surface oxide scale of the stainless steel are more complex than those of a carbon steel, and the surface oxide scale of the stainless steel has a dense structure, strong adhesion to the substrate, and is difficult to remove. Thus, it is derived that in a chemical environment of high-temperature molten salt, the spinel was subjected to a redox reaction by using a strong oxidant (sodium nitrate) or a strong reducing agent (sodium hydride) at 400-550° C. to destroy the spinel structure and makes the oxide scale become loose, and thereafter the oxide scale reacts with nitric acid-hydrofluoric acid. That is, the oxide scale of the stainless steel is removed through the redox principle. Alternatively, most of the oxide scale on the surface of the stainless steel is first removed by using a physical method (mechanical peeling), and then the remaining oxide scale reacts with nitric acid-hydrofluoric acid to achieve the purpose of removing the oxide scale.

The advantage of the above-mentioned method is that the manufacturing process is relatively mature and has been applied by manufacturing enterprises of stainless steel wire rod both at home and abroad. The disadvantage is that a salt bath process for loosening the oxide scale of the stainless steel has a technical problem of high energy consumption; removing the oxide scale of the stainless steel by using a mixed acid of nitric acid-hydrofluoric acid has technical problems of environmental pollution and high cost.

SUMMARY

An objective of the present invention is to solve the technical problems of high energy consumption, environmental pollution, and high cost in the existing method for removing an oxide scale of a stainless steel, and to provide an acid-pickling additive for a surface oxide scale of a stainless steel material, a preparation method thereof and an acid-pickling method. This additive can be stored for a long period of time and is applicable for a variety of acid solutions.

To solve the above-mentioned technical problems, the technical solution adopted by the present invention is: an acid-pickling additive for a surface oxide scale of a stainless steel material, consisting of the following components in weight parts:

1 to 10 parts of an alcohol amine compound, 0.1 to 5 parts of a metal complex ligand, 0 to 10 parts of a nitrogen-containing organic cyclic compound, 0 to 3 parts of an alcohol compound, 0 to 3 parts of a plant extract, and 1 to 2 parts of water.

The alcohol amine compound described by the present invention is a mixture of more than one or two of monoethanolamine, diethanolamine, or triethanolamine in any proportion; and the metal complex ligand includes a mixture of more than one or two of an inorganic metal ligand and an organic metal ligand in any proportion.

The nitrogen-containing organic cyclic compound described by the present invention is a mixture of more than one or two of imidazole, benzimidazole, benzotriazole, quinoline, isoquinoline, hexamethylenetetramine, neutral red, and crystal violet in any-proportion.

The alcohol compound described by the present invention is a mixture of more than one or two of ethylene glycol and polyethylene glycol in any proportion.

The plant extract described by the present invention is comprised of 1 part of plant and 20 parts of water, and a preparation method of the plant extract is: adding the 1 part of plant into the 20 parts of water, heating to 80° C., soaking for 30 minutes, and taking the supernatant.

The inorganic metal ligand described by the present invention is $F^-$, $Cl^-$, $Br^-$, $I^-$, $SO_4^-$, $CN^-$, or $SCN^-$, and the organic metal ligand is acetate, oxalate, sulfosalicylate, aminotriacetate, or ethylenediamine tetraacetate.

The plant described by the present invention is a tobacco leaf or a tea leaf.

The preparation method of the acid-pickling additive for a surface oxide scale of a stainless steel material of the present invention: first water and the plant extract are added into the metal complex ligand and stirred well, then the alcohol amine compound is added and mixed uniformly, and then the nitrogen-containing organic cyclic compound and the alcohol compound are sequentially added and stirred well.

The acid-pickling method using the acid-pickling additive for the surface oxide scale of the stainless steel material of the present invention includes the following steps:

(1) preparing an acid-pickling solution: the preparation method of the acid-pickling solution is: adding concentrated hydrochloric acid into water to make the mass percentage of hydrochloric acid be 5-30%; or adding concentrated hydrochloric acid and a solution containing $F^-$ into water to make the mass percentage of hydrochloric acid be 5-30% and the mass percentage of $F^-$ be 0.5-5%; or adding concentrated sulfuric acid into water to make the mass percentage of sulfuric acid be 5-30%; or adding concentrated sulfuric acid and a solution containing $Cl^-$ into water to make the mass percentage of sulfuric acid be 5-30% and the mass percentage of $Cl^-$ be 5-15%; or adding concentrated sulfuric acid and a solution containing $F^-$ into water to make the mass percentage of sulfuric acid be 5-30% and the mass percentage of $F^-$ be 0.5-10%; or adding concentrated sulfuric acid, a solution containing $Cl^-$ and a solution containing $F^-$ into water to make the mass percentage of sulfuric acid be 5-30%, the mass percentage of $Cl^-$ be 5-15%, and the mass percentage of $F^-$ be 0.5-10%, and then taking an acid-pickling solution prepared by any one of the above-mentioned preparation methods and adding it into an acid-pickling tank;

(2) adding the additive: depending on the difference in types of stainless steel, adding the additive into the acid-pickling solution of step (1) in batches or for once according to a proportion of 1-80 g/L; and (3) acid pickling: first heating the acid-pickling solution in the acid-pickling tank to 30-94° C., then soaking the stainless steel with an oxide scale on the surface thereof into the acid-pickling tank for acid pickling for 15-60 minutes, and finally washing with water, rinsing with high pressure water, passivating, washing with water for the second time, rinsing with high pressure water for the second time, neutralizing, and drying to remove the oxide scale on the surface of the stainless steel material.

For the acid-pickling method using the acid-pickling additive for the surface oxide scale of the stainless steel material of the present invention, when is used for a stainless steel material which is difficult to pickle, the stainless steel material can be pre-treated with an alkaline potassium permanganate solution for 15-60 minutes or be pre-treated by a mechanical shot blasting method before acid pickling.

Compared with the prior art, the present invention eliminates the high-temperature molten salt alkali leaching procedure, and the acid-pickling solution does not contain nitric acid and nitrate, and thus the present invention has the advantages of low energy consumption, low environmental load, a simple process, and low cost.

This method can be used for hot-rolled stainless steel wire rod and bar materials of various brands, can also be used for hot-rolled stainless steel sheet and pipe materials, and especially can be applied in a stainless-steel automatic acid-pickling line.

DETAILED DESCRIPTION

Embodiment 1

An acid-pickling additive for a surface oxide scale of a 1Cr21Mn16Ni2N stainless steel material consists of the following components in weight parts:

1 part of monoethanolamine, 0.1 parts of sodium sulfate, 1 part of water, and 1 part of a plant extract, wherein the plant extract consists of 1 part of a commercially-available tobacco leaf and 20 parts of water, and the preparation method is: adding 1 part of the commercially-available tobacco leaf into the 20 parts of water, heating to 80° C., soaking for 30 minutes, and taking the supernatant to obtain the plant extract.

A preparation method of the additive: first adding 1 part of water and 1 part of the plant extract into 0.1 parts of potassium fluoride and stirring well, then adding monoethanolamine and stirring well.

Acid-Pickling Method:

(1) preparing an acid-pickling solution: adding concentrated hydrochloric acid having a mass percentage of 38% into water to make the mass percentage of hydrochloric acid be 5%, and adding the solution into an acid-pickling tank;

(2) adding the additive: adding the additive into the acid-pickling solution of step (1) in batches according to a proportion of 1 g/L; and (3) acid pickling: first heating the acid-pickling solution in the acid-pickling tank to 30° C., then soaking the stainless steel with an oxide scale on the surface thereof into the acid-pickling tank for acid pickling for 60 minutes, and finally washing with water, rinsing with high pressure water, passivating, washing with water for the second time, rinsing with high pressure water for the second time, neutralizing, and drying to remove the oxide scale on the surface of the stainless steel material.

Embodiment 2

An acid-pickling additive for a surface oxide scale of a 303Cu stainless steel material consists of the following components in weight parts:

3 parts of diethanolamine, 0.5 parts of potassium fluoride, 1 part of benzimidazole, 3 parts of ethylene glycol, and 1.5 parts of water.

A preparation method of the additive: first adding 1.5 parts of water into 0.5 parts of sodium sulfate and stirring well, then adding 3 parts of diethanolamine and stirring well, and then sequentially adding 1 part of benzimidazole and 3 parts of ethylene glycol and stirring well.

Acid-Pickling Method:

(1) preparing an acid-pickling solution: adding concentrated hydrochloric acid having a mass percentage of 38% and a hydrofluoric acid-solution into water to make the mass percentage of hydrochloric acid be 20% and the mass percentage of $F^-$ be 3%, and adding the solution into an acid-pickling tank;

(2) adding the additive: adding the additive into the acid-pickling solution of step (1) for once according to a proportion of 35 g/L; and (3) acid pickling: first heating the acid-pickling solution in the acid-pickling tank to 70° C., then soaking the stainless steel with an oxide scale on the surface thereof into the acid-pickling tank for acid pickling for 30 minutes, and finally washing with water, rinsing with high pressure water, passivating, washing with water for the second time, rinsing with high pressure water for the second time, neutralizing, and drying to remove the oxide scale on the surface of the stainless steel material.

Embodiment 3

An acid-pickling additive for a surface oxide scale of a 430 stainless steel material consists of the following components in weight parts:

5 parts of triethanolamine, 2 parts of sodium bromide, 2 parts of benzotriazole, 3 parts of polyethylene glycol, 2 parts of a plant extract and 2 parts of water, wherein the plant extract consists of 1 part of a commercially-available tea leaf and 20 parts of water, and the preparation method is: adding 1 part of the commercially-available tea leaf into the 20 parts of water, heating to 80° C., soaking for 30 minutes, and taking the supernatant to obtain the plant extract.

A preparation method of the additive: first adding 2 parts of water and 2 parts of the plant extract into 2 parts of sodium bromide and stirring well, then adding 5 parts of triethanolamine and stirring well, and then sequentially adding 2 parts of benzotriazole and 3 parts of polyethylene glycol and stirring well.

Acid-Pickling Method:

(1) preparing an acid-pickling solution: adding concentrated hydrochloric acid having a mass percentage of 38% and a sodium fluoride solution into water to make the mass percentage of hydrochloric acid be 30% and the mass percentage of $F^-$ be 5%, and adding the solution into an acid-pickling tank;

(2) adding the additive: adding the additive into the acid-pickling solution of step (1) for once according to a proportion of 50 g/L; and (3) acid pickling: first heating the acid-pickling solution in the acid-pickling tank to 85° C., then soaking the stainless steel with an oxide scale on the surface thereof into the acid-pickling tank for acid pickling for 20 minutes, and finally washing with water, rinsing with high pressure water, passivating, washing with water for the second time, rinsing with high pressure water for the second time, neutralizing, and drying to remove the oxide scale on the surface of the stainless steel material.

Embodiment 4

An acid-pickling additive for a surface oxide scale of a 304 stainless steel material consists of the following components in weight parts:

6 parts of monoethanolamine, 0.5 parts of potassium iodide, 1 part of quinoline, 0.5 parts of ethylene glycol, 3 parts of a plant extract and 1.5 parts of water, wherein the components and the preparation method of the plant extract are the same as those of the plant extract of Embodiment 3.

A preparation method of the additive: first adding 1.5 parts of water and 3 parts of the plant extract into 0.5 parts of potassium iodide and stirring well, then adding 6 parts of monoethanolamine and stirring well, and then sequentially adding 1 part of quinoline and 0.5 parts of ethylene glycol and stirring well.

Acid-Pickling Method:

(1) preparing an acid-pickling solution: adding concentrated sulfuric acid having a mass percentage of 98% into water to make the mass percentage of sulfuric acid be 30%, and adding the solution into an acid-pickling tank;

(2) adding the additive: adding the additive into the acid-pickling solution of step (1) for once according to a proportion of 15 g/L; and (3) acid pickling: first heating the acid-pickling solution in the acid-pickling tank to 80° C., then soaking the stainless steel with an oxide scale on the surface thereof into the acid-pickling tank for acid pickling for 15 minutes, and finally washing with water, rinsing with high pressure water, passivating, washing with water for the second time, rinsing with high pressure water for the second time, neutralizing, and drying to remove the oxide scale on the surface of the stainless steel material.

Embodiment 5

An acid-pickling additive for a surface oxide scale of a 310 stainless steel material consists of the following components in weight parts:

7 parts of diethanolamine, 3 parts of potassium chloride, 4 parts of isoquinoline, 1 part of ethylene glycol, 0.5 parts of a plant extract and 1 part of water, wherein the components and the preparation method of the plant extract are the same as those of the plant extract of Embodiment 3.

A preparation method of the additive: first adding 1 part of water and 0.5 parts of the plant extract into 3 parts of potassium chloride and stirring well, then adding 7 parts of diethanolamine and stirring well, and then sequentially adding 4 parts of isoquinoline and 1 part of ethylene glycol and stirring well.

Acid-Pickling Method:

preparing an acid-pickling solution: adding concentrated sulfuric acid having a mass percentage of 98% and concentrated hydrochloric acid having a mass percentage of 37% into water to make the mass percentage of sulfuric acid be 5% and the mass percentage of $Cl^-$ be 15%, and adding the solution into an acid-pickling tank;

adding the additive: adding the additive into the acid-pickling solution of step (1) for once according to a proportion of 25 g/L; and acid pickling: first heating the acid-pickling solution in the acid-pickling tank to 85° C., then soaking the stainless steel with an oxide scale on the surface thereof into the acid-pickling tank for acid pickling for 45 minutes, and finally washing with water, rinsing with high pressure water, passivating, washing with water for the second time, rinsing with high pressure water for the second time, neutralizing, and drying to remove the oxide scale on the surface of the stainless steel material.

Embodiment 6

An acid-pickling additive for a surface oxide scale of a 410 stainless steel material consists of the following components in weight parts:

8 parts of triethanolamine, 4 parts of potassium cyanide, 5 parts of hexamethylenetetramine, 1.5 parts of polyethylene glycol, 1 part of a plant extract and 1.5 parts of water, wherein the components and the preparation method of the plant extract are the same as those of the plant extract of Embodiment 1.

The specific preparation method of the additive: first adding 1.5 parts of water and 1 part of the plant extract into 4 parts of potassium cyanide and stirring well, then adding 8 parts of triethanolamine and stirring well, and then sequentially adding 5 parts of hexamethylenetetramine and 1.5 parts of polyethylene glycol and stirring well.

Acid-Pickling Method:

preparing an acid-pickling solution: adding concentrated sulfuric acid having a mass percentage of 98% and a sodium chloride solution into water to make the mass percentage of sulfuric acid be 20% and the mass percentage of $Cl^-$ be 10%, and adding the solution into an acid-pickling tank;

adding the additive: adding the additive into the acid-pickling solution of step (1) for once according to a proportion of 25 g/L; and acid pickling: first heating the acid-pickling solution in the acid-pickling tank to 80° C., then soaking the stainless steel with an oxide scale on the surface thereof into the acid-pickling tank for acid pickling for 60 minutes, and finally washing with water, rinsing with high pressure water, passivating, washing with water for the second time, rinsing with high pressure water for the second time, neutralizing, and drying to remove the oxide scale on the surface of the stainless steel material.

Embodiment 7

An acid-pickling additive for a surface oxide scale of a 316 stainless steel material consists of the following components in weight parts:

9 parts of monoethanolamine, 5 parts of potassium thiocyanate, 0.3 parts of neutral red, 2 parts of polyethylene glycol, 1.5 parts of a plant extract and 2 parts of water, wherein the components and the preparation method of the plant extract are the same as those of the plant extract of Embodiment 1.

The specific preparation method of the additive: first adding 2 parts of water and 1.5 parts of the plant extract into 5 parts of potassium thiocyanate and stirring well, then adding 9 parts of monoethanolamine and stirring well, and then sequentially adding 0.3 parts of neutral red and 2 parts of polyethylene glycol and stirring well.

Acid-Pickling Method:

preparing an acid-pickling solution: adding concentrated sulfuric acid having a mass percentage of 98% and a hydrofluoric acid solution into water to make the mass percentage of sulfuric acid be 5% and the mass percentage of $F^-$ be 10%, and adding the solution into an acid-pickling tank;

adding the additive: adding the additive into the acid-washing solution of step (1) in batches according to a proportion of 30 g/L; and acid pickling: first heating the acid-pickling solution in the acid-pickling tank to 94° C., then soaking the stainless steel with an oxide scale on the surface thereof into the acid-pickling tank for acid pickling for 45 minutes, and finally washing with water, rinsing with high pressure water, passivating, washing with water for the second time, rinsing with high pressure water for the second time, neutralizing, and drying to remove the oxide scale on the surface of the stainless steel material.

Embodiment 8

An acid-pickling additive for a surface oxide scale of an ER307Si stainless steel material consists of the following components in weight parts:

10 parts of diethanolamine, 0.5 parts of sodium acetate, 1 part of crystal violet, 3 parts of polyethylene glycol, 2 parts of a plant extract and 2 parts of water, wherein the components and the preparation method of the plant extract are the same as those of the plant extract of Embodiment 1.

A specific preparation method of the additive: first adding 2 parts of water and 2 parts of the plant extract into 0.5 parts of sodium acetate and stirring well, then adding 10 parts of diethanolamine and stirring well, and then sequentially adding 1 part of crystal violet and 3 parts of polyethylene glycol and stirring well.

Acid-Pickling Method:

preparing an acid-pickling solution: adding concentrated sulfuric acid having a mass percentage of 98% and a sodium fluoride solution into water to make the mass percentage of sulfuric acid be 10% and the mass percentage of $F^-$ be 5%, and adding the solution into an acid-pickling tank;

adding the additive: adding the additive into the acid-washing solution of step (1) in batches according to a proportion of 15 g/L; and acid pickling: first heating the acid-pickling solution in the acid-pickling tank to 80° C., then soaking the stainless steel with an oxide scale on the surface thereof into the acid-pickling tank for acid pickling for 20 minutes, and finally washing with water, rinsing with high pressure water, passivating, washing with water for the second time, rinsing with high pressure water for the second time, neutralizing, and drying to remove the oxide scale on the surface of the stainless steel material.

Embodiment 9

An acid-pickling additive for a surface oxide scale of a 420F stainless steel material consists of the following components in weight parts:

5 parts of monoethanolamine, 0.5 parts of potassium oxalate, 2 parts of imidazole, 3 parts of benzimidazole, 3 parts of polyethylene glycol, 2 parts of a plant extract and 2 parts of water, wherein the components and the preparation method of the plant extract are the same as those of the plant extract of Embodiment 1.

A specific preparation method of the additive: first adding 2 parts of water and 2 parts of the plant extract into 0.5 parts of potassium oxalate and stirring well, then adding 5 parts of monoethanolamine and stirring well, and then sequentially adding 2 parts of imidazole, 3 parts of benzimidazole and 3 parts of polyethylene glycol and stirring well.

Acid-Pickling Method:

preparing an acid-pickling solution: adding concentrated sulfuric acid having a mass percentage of 98%, a hydrofluoric acid solution and concentrated hydrochloric acid into water to make the mass percentage of sulfuric acid be 0.5%, the mass percentage of $Cl^-$ be 15%, and the mass percentage of $F^-$ be 10%, and adding the solution into an acid-pickling tank; and adding a sulfuric acid solution having a concentration of 25%+a hydrochloric acid solution having a concentration of 10%+a hydrofluoric acid solution having a concentration of 8% into the acid-pickling tank;

adding the additive: adding the additive into the acid-pickling solution of step (1) for once according to a proportion of 40 g/L; and acid pickling: first heating the acid-pickling solution in the acid-pickling tank to 80° C., then soaking the stainless steel with an oxide scale on the surface thereof into the acid-pickling tank for acid pickling for 30 minutes, and finally washing with water, rinsing with high pressure water, passivating, washing with water for the second time, rinsing with high pressure water for the second time, neutralizing, and drying to remove the oxide scale on the surface of the stainless steel material.

Embodiment 10

An acid-pickling additive for a surface oxide scale of a 201 stainless steel material consists of the following components in weight parts:

7 parts of monoethanolamine, 0.5 parts of sulfosalicylic acid, 2 parts of quinoline, 0.5 parts of isoquinoline, 3 parts of ethylene glycol, 2 parts of a plant extract and 2 parts of water, wherein the components and the preparation method of the plant extract are the same as those of the plant extract of Embodiment 1.

A preparation method of the additive: first adding 2 parts of water and 2 parts of the plant extract into 0.5 parts of sulfosalicylic acid and stirring well, then adding 7 parts of monoethanolamine and stirring well, and then sequentially adding 2 parts of quinoline, 0.5 parts of isoquinoline and 3 parts of ethylene glycol and stirring well.

Acid-Pickling Method:

preparing an acid-pickling solution: adding concentrated sulfuric acid having a mass percentage of 98%, a sodium fluoride solution and concentrated hydrochloric acid into water to make the mass percentage of sulfuric acid be 5%, the mass percentage of $Cl^-$ be 10%, and the mass percentage of $F^-$ be 5%, and adding the solution into an acid-pickling tank; and adding the additive: adding the additive into the acid-pickling solution of step (1) for once according to a proportion of 35 g/L; and acid pickling: first heating the acid-pickling solution in the acid-pickling tank to 60° C., then soaking the stainless steel with an oxide scale on the surface thereof into the acid-pickling tank for acid pickling for 45 minutes, and finally washing with water, rinsing with high pressure water, passivating, washing with water for the second time, rinsing with high pressure water for the second time, neutralizing, and drying to remove the oxide scale on the surface of the stainless steel material.

Embodiment 11

An acid-pickling additive for a surface oxide scale of a 430F stainless steel material consists of the following components in weight parts:

7 parts of monoethanolamine, 0.5 parts of aminotriacetic acid, 2 parts of quinoline, 5 parts of isoquinoline, 3 parts of ethylene glycol, 2 parts of a plant extract and 2 parts of water, wherein the components and the preparation method of the plant extract are the same as those of the plant extract of Embodiment 1.

A preparation method of the additive: first adding 2 parts of water and 2 parts of the plant extract into 0.5 parts of aminotriacetic acid and stirring well, then adding 7 parts of monoethanolamine and stirring well, and then sequentially adding 2 parts of quinoline, 5 parts of isoquinoline and 3 parts of ethylene glycol and stirring well.

Acid-Pickling Method:

preparing an acid-pickling solution: adding concentrated sulfuric acid having a mass percentage of 98%, a sodium fluoride solution and potassium chloride into water to make the mass percentage of sulfuric acid be 30%, the mass percentage of $Cl^-$ be 5%, and the mass percentage of $F^-$ be 0.5%, and adding the solution into an acid-pickling tank; and adding the additive: adding the additive into the acid-pickling solution of step (1) for once according to a proportion of 50 g/L; and acid pickling: first heating the acid-pickling solution in the acid-pickling tank to 75'C, then soaking the stainless steel with an oxide scale on the surface thereof into the acid-pickling tank for acid pickling for 35 minutes, and finally washing with water, rinsing with high pressure water, passivating, washing with water for the second time, rinsing with high pressure water for the second time, neutralizing, and drying to remove the oxide scale on the surface of the stainless steel material.

Embodiment 12

An acid-pickling additive for a surface oxide scale of a 420J2 stainless steel material consists of the following components in weight parts:

7 parts of monoethanolamine, 0.5 parts of ethylenediamine tetraacetic acid, 1 part of quinoline, 2 parts of isoquinoline, 3 parts of ethylene glycol, 2 parts of a plant extract and 2 parts of water, wherein the components and the preparation method of the plant extract are the same as those of the plant extract of Embodiment 1.

A preparation method of the additive: first adding 2 parts of water and 2 parts of the plant extract into 0.5 parts of ethylenediamine tetraacetic acid and stirring well, then adding 7 parts of monoethanolamine and stirring well, and then sequentially adding 1 part of quinoline, 2 parts of isoquinoline and 3 parts of ethylene glycol and stirring well.

Acid-Pickling Method:

preparing an acid-pickling solution: adding concentrated sulfuric acid having a mass percentage of 98%, a hydrofluoric acid solution and sodium chloride into water to make the mass percentage of sulfuric acid be 15%, the mass percentage of $Cl^-$ be 8%, and the mass percentage of $F^-$ be 4%, and adding the solution into an acid-pickling tank; and adding the additive: adding the additive into the acid-washing solution of step (1) in batches according to a proportion of 20 g/L as desired for washing until the concentration of the additive is 80 g/L; and acid pickling: first heating the acid-pickling solution in the acid-pickling tank to 90° C., then soaking the stainless steel with an oxide scale on the surface thereof into the acid-pickling tank for acid pickling for 30 minutes, and finally washing with water, rinsing with high pressure water, passivating, washing with water for the second time, rinsing with high pressure water for the second time, neutralizing, and drying to remove the oxide scale on the surface of the stainless steel material.

For a stainless steel material which is difficult to pickle, the stainless steel material can be pre-treated with an alkaline potassium permanganate solution for 15-60 minutes or be pre-treated by a mechanical shot blasting method before acid pickling.

What is claimed is:

1. An acid-pickling additive for a surface oxide scale of a stainless steel material, consisting of the following components in weight parts:

1 to 10 parts of an alcohol amine compound, 0.1 to 5 parts of a complexing agent, more than 0 and up to 10 parts of a nitrogen-containing organic cyclic compound, 0 to 3 parts of an alcohol compound, 0 to 3 parts of a plant extract, and 1 to 2 parts of water;

wherein the nitrogen-containing organic cyclic compound is at least one selected from the group consisting of imidazole, benzimidazole, benzotriazole, quinoline, isoquinoline, hexamethylenetetramine, neutral red, and crystal violet.

2. The acid-pickling additive for a surface oxide scale of a stainless steel material of claim 1, wherein the alcohol amine compound is at least one selected from the group consisting of monoethanolamine, diethanolamine, and triethanolamine; and the complexing agent comprises at least one selected from the group consisting of an inorganic complexing agent and an organic complexing agent.

3. The acid-pickling additive for a surface oxide scale of a stainless steel material of claim 2, wherein the anion of the inorganic complexing agent is $F^-$, $Cl^-$, $Br^-$, $I^-$, $SO_4^-$, $CN^-$, or $SCN^-$, and the anion of the organic complexing agent is acetate, oxalate, sulfosalicylate, aminotriacetate, or ethylenediaminetetraacetate.

4. The acid-pickling additive for a surface oxide scale of a stainless steel material of claim 1, wherein the alcohol compound is at least one selected from the group consisting of ethylene glycol and polyethylene glycol.

5. The acid-pickling additive for a surface oxide scale of a stainless steel material of claim 1, wherein the plant extract is comprised of 1 part of plant and 20 parts of water, and a preparation method of the plant extract is: adding the 1 part of plant into the 20 parts of water, heating to 80° C., soaking for 30 minutes to obtain a solution with supernatant, and using the supernatant.

6. The acid-pickling additive for a surface oxide scale of a stainless steel material of claim 5, wherein the plant is a tobacco leaf or a tea leaf.

7. A method for preparing the acid-pickling additive for a surface oxide scale of a stainless steel material of claim 1, wherein, first, water and the plant extract are added into the complexing agent and stirred uniformly, then the alcohol amine compound is added and mixed uniformly, and then the nitrogen-containing organic cyclic compound and the alcohol compound are sequentially added and stirred uniformly.

8. An acid-pickling method using the acid-pickling additive for a surface oxide scale of a stainless steel material of claim 1, comprising the steps of:

(1) preparing an acid-pickling solution: the preparation method of the acid-pickling solution is: adding concentrated hydrochloric acid into water to make the mass percentage of hydrochloric acid be 5-30%; or adding concentrated hydrochloric acid and a solution containing $F^-$ into water to make the mass percentage of hydrochloric acid be 5-30% and the mass percentage of $F^-$ be 0.5-5%; or adding concentrated sulfuric acid into water to make the mass percentage of sulfuric acid be 5-30%; or adding concentrated sulfuric acid and a solution containing $Cl^-$ into water to make the mass percentage of sulfuric acid be 5-30% and the mass percentage of $Cl^-$ be 5-15%; or adding concentrated sulfuric acid and a solution containing $F^-$ into water to make the mass percentage of sulfuric acid be 5-30% and the mass percentage of $F^-$ be 0.5-10%; or adding concentrated sulfuric acid, a solution containing $Cl^-$ and a solution containing $F^-$ into water to make the mass percentage of sulfuric acid be 5-30%, the mass percentage of $Cl^-$ be 5-15%, and the mass percentage of $F^-$ be 0.5-10%, and then taking an acid-pickling solution prepared by any one of the above-mentioned preparation methods and adding it into an acid-pickling tank;

(2) adding the additive: depending on the type of stainless steel, adding the additive into the acid-pickling solution of step (1) in batches or for once according to a proportion of 1-80 g/L; and (3) acid pickling: first heating the acid-pickling solution in the acid-pickling tank to 30-94° C., then soaking the stainless steel with an oxide scale on the surface thereof into the acid-pickling tank for acid pickling for 15-60 minutes, and finally washing the stainless steel with water, rinsing the stainless steel with water, passivating the stainless steel, washing the stainless steel with water for a second time, rinsing the stainless steel with water for a second time, neutralizing the stainless steel, and drying the stainless steel to remove the oxide scale on the surface of the stainless steel material.

9. The acid-pickling method using the acid-pickling additive for a surface oxide scale of a stainless steel material of claim 8, wherein the stainless steel material is pre-treated with an alkaline potassium permanganate solution for 15-60 minutes or is pre-treated by a mechanical shot blasting method before acid pickling.

* * * * *